US009089852B2

(12) United States Patent
Terholsen

(10) Patent No.: US 9,089,852 B2
(45) Date of Patent: Jul. 28, 2015

(54) FULLY JACKETED SCREW CENTRIFUGE WITH A HOSE SEGMENT ARRANGED IN THE SOLIDS CAPTURE CHAMBER

(71) Applicant: GEA Mechanical Equipment GmbH, Oelde (DE)

(72) Inventor: Stefan Terholsen, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 0 days.

(21) Appl. No.: 14/367,747

(22) PCT Filed: Dec. 10, 2012

(86) PCT No.: PCT/EP2012/074878

§ 371 (c)(1),
(2) Date: Jun. 20, 2014

(87) PCT Pub. No.: WO2013/092262

PCT Pub. Date: Jun. 27, 2013

(65) Prior Publication Data

US 2014/0364297 A1 Dec. 11, 2014

(30) Foreign Application Priority Data

Dec. 22, 2011 (DE) ..... 20 2011 052 424 U

(51) Int. Cl.
*B04B 7/04* (2006.01)
*B04B 11/02* (2006.01)
(Continued)

(52) U.S. Cl.
CPC . *B04B 11/02* (2013.01); *B04B 1/20* (2013.01); *B04B 7/04* (2013.01); *B04B 7/08* (2013.01); *B04B 2001/2091* (2013.01)

(58) Field of Classification Search
CPC ..... B04B 1/20; B04B 7/04; B04B 11/08; B04B 15/06; B04B 2001/2091; B04B 2011/086; B04B 2011/088
USPC ..... 494/53–56; 210/380.3
See application file for complete search history.

(56) References Cited

U.S. PATENT DOCUMENTS 3,105,045 A * 9/1963 Borig ..... 494/60
3,399,828 A * 9/1968 Fassle ..... 494/11
(Continued)

FOREIGN PATENT DOCUMENTS

DE 42 38 568 A1 5/1994
DE 4238568 A1 * 5/1994 ..... B04B 1/20
(Continued)

OTHER PUBLICATIONS

International Search Report (PCT/ISA/210) dated Apr. 9, 2014 with English translation thereof {Six (6) pages}.

*Primary Examiner* — Charles Cooley
(74) *Attorney, Agent, or Firm* — Crowell & Moring LLP

(57) ABSTRACT

A fully jacketed screw centrifuge includes a rotatable drum having a horizontally oriented rotational axis, a rotatable screw arranged in the drum, and at least one discharge opening oriented at an angle to the rotational axis of the fully jacketed screw centrifuge for discharging solid from the drum in the jacket of the drum. A collecting chamber for solid, which surrounds the drum that rotates during operation in some sections and which does not rotate during operation, is associated with the at least one discharge opening. At least one hose segment not circumferentially closed in the cross-section is arranged in the collecting chamber. The hose segment is composed of an elastomeric material, which oscillates when impinged by discharged solids to reduce accumulation of the discharged solids on the hose segment.

8 Claims, 3 Drawing Sheets

(51) Int. Cl.
*B04B 1/20* (2006.01)
*B04B 7/08* (2006.01)

(56) References Cited

U.S. PATENT DOCUMENTS

| | | | | | |
|---|---|---|---|---|---|
| 4,397,637 | A * | 8/1983 | Place | 494/1 | |
| 4,617,010 | A * | 10/1986 | Epper et al. | 494/52 | |
| 5,151,079 | A * | 9/1992 | Flanigan et al. | 494/27 | |
| 5,156,751 | A * | 10/1992 | Miller | 210/787 | |
| 5,338,285 | A * | 8/1994 | Omori | 494/55 | |
| 5,552,173 | A * | 9/1996 | Singh et al. | 426/417 | |
| 5,593,377 | A | 1/1997 | Figgener et al. | | |
| 5,800,332 | A * | 9/1998 | Hensley | 494/53 | |
| 7,311,654 | B2 | 12/2007 | Ostkamp | | |
| 7,540,838 | B2 * | 6/2009 | Scott et al. | 494/7 | |
| 8,042,281 | B1 * | 10/2011 | Estes et al. | 34/312 | |
| 8,956,272 | B2 * | 2/2015 | Vanderbeken et al. | 494/37 | |
| 2012/0245014 | A1 * | 9/2012 | Jones et al. | 494/37 | |
| 2013/0168317 | A1 * | 7/2013 | Vanderbeken | 210/663 | |
| 2013/0172167 | A1 * | 7/2013 | Vanderbeken et al. | 494/37 | |
| 2014/0364297 | A1 * | 12/2014 | Terholsen | 494/66 | |

FOREIGN PATENT DOCUMENTS

| | | | | |
|---|---|---|---|---|
| DE | 43 20 265 | A1 | 12/1994 | |
| EP | 2740539 | A1 * | 6/2014 | |
| JP | 04059065 | A * | 2/1992 | B04B 1/20 |
| JP | 05076795 | A * | 3/1993 | B04B 1/20 |
| JP | 06071198 | A * | 3/1994 | B04B 1/20 |
| WO | WO 2004/058409 | A2 | 7/2004 | |
| WO | WO 2013/092262 | A3 * | 6/2013 | |

* cited by examiner

FULLY JACKETED SCREW CENTRIFUGE WITH A HOSE SEGMENT ARRANGED IN THE SOLIDS CAPTURE CHAMBER

BACKGROUND AND SUMMARY OF THE INVENTION

Exemplary embodiments of the invention relate to a solid bowl screw centrifuge.

German patent document DE 43 20 265 A1 and PCT International patent document WO 2004/058409 A1 disclose solid bowl screw centrifuges.

German patent document DE 42 38 568 A1 illustrates in FIG. 1 how dirt can accumulate in a solids capture chamber when a solid bowl screw centrifuge is in operation. This necessitates repeated cleaning of the solids capture chamber in order to avoid operating impairments caused by blockages or even damage to the rotating system.

To solve this problem, U.S. Pat. No. 3,399,828 discloses forming at the solids discharge of a solid bowl screw centrifuge, at its tapering end, a solids capture chamber in which is arranged, tension-mounted, an elastic air-impermeable diaphragm covering an air duct that is closed off, air-tight, with respect to the surroundings and with respect to the actual solids capture chamber. By the action of compressed air, pressure fluctuations can be generated at the diaphragm which set the latter in oscillation, thus serving to release dirt from the walls of the capture chamber, here the diaphragm.

Although the problem of dirt is reduced in this way, the problem still appears to be the relatively high outlay in terms of apparatus and structure for generating pressure fluctuations at the elastic diaphragm. Furthermore, it is relatively difficult to change the diaphragms, since the diaphragms repeatedly have to be mounted, pressure-tight, in the solids capture chamber.

Exemplary embodiments of the invention are directed to eliminating this problem.

According to the invention, advantageously, in spite of dispensing with a chamber that is closed by an elastomer and in which a pressure gradient can be generated by the action of compressed air, movements in the elastomeric element in the solids capture chamber are sufficiently generated, solely by the impact of the solid, in order to release dirt. The number of cleanings of the solids capture chamber can consequently be reduced, compared with solids capture chambers without an elastomeric element. Moreover, maintenance work is simplified as compared with solutions with a pressure chamber in which a pressure gradient can be generated, since the elastomer no longer has to be arranged so as to be pressure-tight. Moreover, as compared with such solutions, there is no need for the means required for generating the pressure gradient (for example, a controllable pump).

A further advantage is the noise reduction achieved, since the impingement momentum of the solids is effectively decoupled vibrationally from the stand or the noise-radiating surface of the centrifuge, and since the hose segment implements a dual-shell structure which has a noise-insulating effect. This is also advantageous especially in the case of harder and coarse solids and when there is a high discharge of solids for a unit time (or high solids performance).

BRIEF DESCRIPTION OF THE DRAWING FIGURES

The invention is explained in more detail below by means of exemplary embodiments, with reference to the drawing in which.

DETAILED DESCRIPTION

Figure 1:
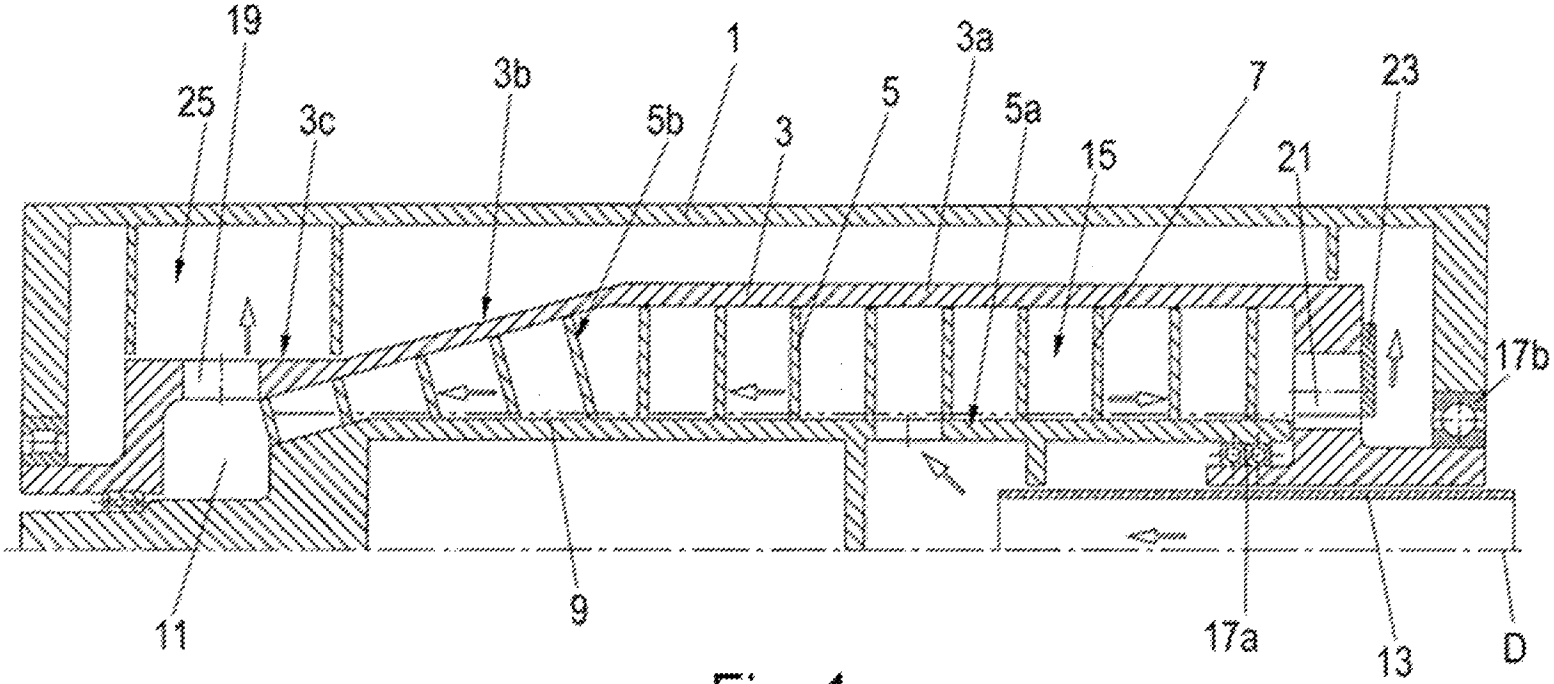
Fig. 1 PRIOR ART
FIG. 1 shows a section through part of a solid bowl screw centrifuge with a known solids capture chamber.

FIG. 1 shows a solid bowl screw centrifuge with a non-rotatable housing 1 (or a hood-like cover), in which is arranged a rotatable drum 3 which has a horizontal axis of rotation D. Furthermore, a screw 5 preferably rotatable at a differential rotational speed with respect to the drum 3 is arranged in said drum 3.

The drum 3 and the screw 5 each have an essentially cylindrical portion 3*a*, 5*a* and a tapering portion 3*b*, 5*b* adjoining the latter. The screw blade 7 surrounds both the cylindrical region and the tapering region of the screw body 9.

Furthermore, the drum 3 also has a further cylindrical portion 3*c* adjoining the conically tapering portion 3*b* and which defines a co-rotating solids discharge chamber 11.

An axially extending centric inflow pipe 13 feeds the centrifugable material via a distributor 9 into the centrifuging space 15 between the screw 5 and the drum 3.

If, for example, a sludgy pulp is conducted into the centrifuge, solid particles settle on the drum wall. A liquid phase is formed further inward.

The mounted screw 5 (bearing 17*a*) rotates at a somewhat lower or higher speed than the rotatably mounted drum 3 (bearing 17*b*) and conveys the ejected solids toward the conical portion 3*b* and, furthermore, to the cylindrical solids discharge chamber 11 adjoining the screw in the axial direction and located in the second cylindrical region 3*c* of the drum 3, the solids discharge chamber in turn being provided with at least one solids discharge port 19 leading out of the drum 3 radially outward. This outlet port may also be oriented at an angle to the radial, for example in order to achieve an energy-saving repulse effect in the circumferential direction (not illustrated here).

By contrast, the liquid flows to the larger drum diameter at the rear end of the cylindrical portion of the drum 3 and is diverted there at overflow ports 21, here with an adjustable weir 23.

Figure 3:
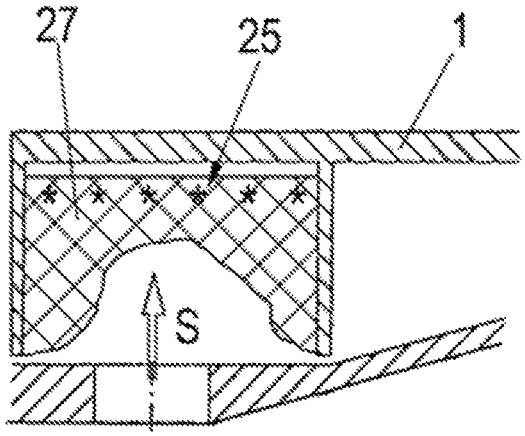
Fig. 3 PRIOR ART
FIG. 3 shows a section through a solids capture chamber of the solid bowl screw centrifuge of FIG. 1 in the dirty state.

The solids S emerging from the solids discharge port 19 of the rotating drum 3 collect in a solids capture chamber 25 which surrounds the solids discharge chamber annularly and of which the cross-section, here of the rectangular type, can be seen in FIGS. 1 and 3. This cross section is preferably provided, but is not mandatory. A diverting pipe may exit preferably vertically downward (not illustrated here) from the solids capture chamber or a capture container may be provided in order further to divert or to capture the sludgy solids which have emerged.

FIG. 3 illustrates that, when the solids bowl screw centrifuge is in operation, accretions 27 may form in the solids capture chamber 25 and therefore the latter has to be cleaned repeatedly.

Figure 2:
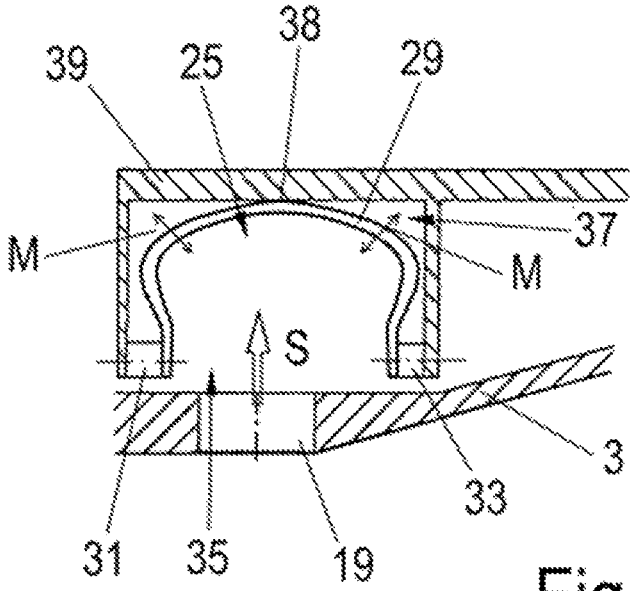
FIG. 2 shows a section though a solids capture chamber configured according to the invention for a solid bowl screw centrifuge particularly of the type of FIG. 1.

In order to reduce the number of cleaning operations, as illustrated in FIG. 2, a hose segment 29 is arranged in the solids capture chamber of a solid bowl screw centrifuge (for example, but not necessarily, of the type of FIG. 1). The hose segment 29 has a non-planary cross section and is preferably not circumferentially closed in cross-section on the circumference (see FIG. 3). This hose segment 29 is preferably arranged virtually in the form of a ring in the solids capture chamber, so that the hose segment surrounds the drum in the region of the solids discharge port 19 virtually completely, preferably with the exception of an outlet port into a diversion or a capture container (not illustrated here).

The cross-section, in the section perpendicular to the chamber, is preferably non-planar, but preferably C-shaped, U-shaped or Ω-shaped, the open side of the C, of the U or of the Ω facing the solids discharge port 19. The non-circumferentially closed region 35 of the hose segment 29 therefore faces the discharge port 19. The two open margins of the hose segment may be fastened to small webs 31, 33. The margins are oriented parallel to one another here.

During operation, solids are thrown through the discharge port or discharge ports 19 into the solids capture chamber 25 where they impinge onto the inside, facing the discharge port or discharge ports 19, of the hose segment 29. As a result, (essentially oscillation-like) movements M are excited in the hose segment 29 moveable elastically per se, which movements prevent the accretion of solids or contribute to releasing accreting solids from the hose segment again.

The number of cleanings can be reduced in this way. Moreover, it is easy to change the hose segment 29, since the chamber or the space 37 "behind" the hose segment 29 does not have to be or is not designed to be pressure-tight.

As can be seen in FIG. 2, the hose segment 29 may bear directly, in a region preferably spaced apart from the fastening regions (here at the webs 30, 31) in the solids capture chamber 25, here in a region on the outside, facing away from the discharge port 19, of the hose segment, against an inside 38 of a wall 39 of the solids discharge chamber 11 (u-shaped in section here and formed from walls oriented at right angles to one another). As a result, during operation, pronounced movements (arrows M) occur particularly in the region of the corner zones. This is advantageous because these are also the regions where deposits are preferentially formed.

Figure 4:
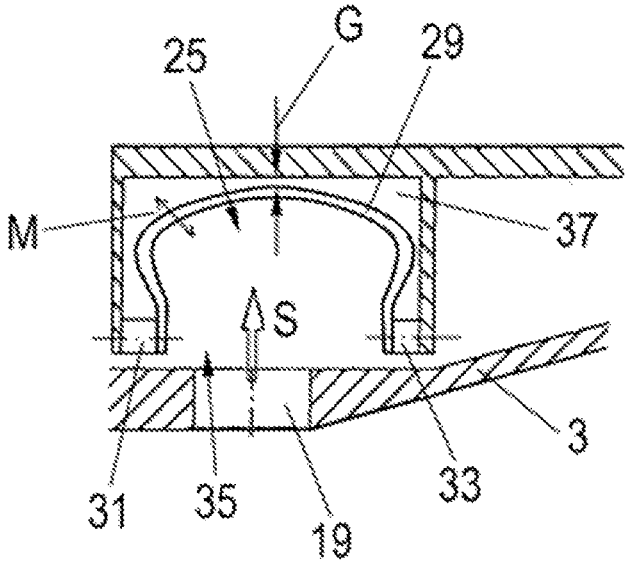
FIGS. 4 and 5 show sections through further solids capture chambers configured according to the invention, in each case for a solid bowl screw centrifuge particularly of the type of FIG. 1.

As can be seen in FIG. 4 however, the hose segment 29 may also be arranged so as to be spaced apart (gap G) from the inside 38 of the walls of the solids discharge chamber 11 completely (apart from the direct or indirect connection to the walls of the solids discharge chamber via the webs 30, 31). This is particularly advantageous in terms of the generation of noise which is reduced here once again, as compared with FIG. 2. Moreover, any point of the hose segment can move freely in order thereby to prevent an accretion of the solids and/or release existing accretions again.

The hose segment is preferably composed entirely (FIG. 2, FIG. 4) of an elastomer (for example a rubber material) or is formed as a composite part that is composed partially of an elastomer (see FIG. 5) and partially of a non-elastomeric material such as a metal, for example steel or the like.

Figure 5:
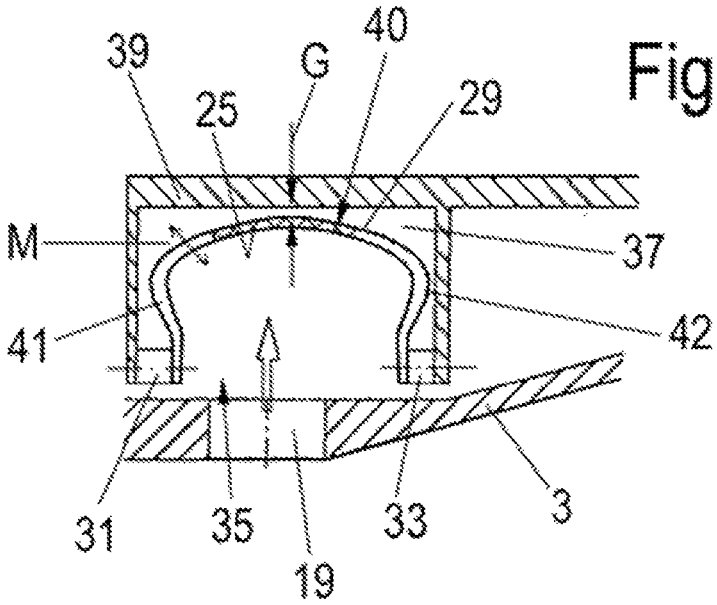

According to the advantageous example of FIG. 5, the base limb 40 of the hose-shaped segment is composed of metal (or of a coated metal or the like) and the side limbs 41, 42 of the u-shaped hose segment are composed of the moveable elastomer.

The limbs 41, 42 are consequently moveable and the base limb 40 is per se immovable. This variant is especially stable and durable since the rigid portion or limb constitutes wear protection. The number of necessary cleaning operations is nevertheless markedly reduced, since, upon the impingement of solids, the base limb 40 is also co-moved via the limbs 41, 42. Moreover, the material can slide off the metal limb especially effectively.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

Housing 1
Drum 3
Screw 5
Cylindrical portions 3*a*, 3*c*, 5*a*
Tapering portions 3*b*, 5*b*
Screw blade 7
Screw body 9
Solids discharge chamber 11
Inflow pipe 13
Centrifuging space 15
Bearing 17*a, b*
Discharge port 19
Overflow ports 21
Weir 23
Solids capture chamber 25
Accretions 27
Hose segment 29
Webs 31, 33
Region 35
Space 37
Inside 38
Wall 39
Base limb 40
Limbs 41, 42
Axis of rotation D
Movements M
Solids S
Gap G

The invention claimed is:

1. A solid bowl screw centrifuge, comprising:

a rotatable drum with a horizontal axis of rotation;

a rotatable screw arranged in the rotatable drum;

at least one discharge port, oriented at an angle to an axis of rotation of the solid bowl screw centrifuge, the at least one discharge port is configured to discharge solids from a bowl of the rotatable drum, wherein the at least one discharge port is assigned a solids capture chamber that partially surrounds the drum rotating during operation and which does not rotate during operation; and a hose segment is arranged in the solids capture chamber, wherein the hose segment is not circumferentially closed in cross-section, wherein the hose segment is composed of an elastomeric material, wherein the solids capture chamber is configured so that no pressure gradient can be generated in the solids capture chamber and the elastomer material is arranged in the solids capture chamber so that the elastomer material is not pressure-tight in the solids capture chamber, wherein the non-circumferentially closed hose segment is arranged as a ring in the solids capture chamber, so that the hose segment almost completely surrounds the drum in a region of the discharge port except for an outlet port into a diversion or a capture container, wherein the non-circumferentially closed region of the hose segment has a C-shaped, U-shaped or Ω-cross-section.

2. The solid bowl screw centrifuge of claim 1, wherein the hose segment has a structure and is arranged in the solids capture chamber so that the hose segment is excited to oscillatory movements upon impingement of solids.

3. The solid bowl screw centrifuge of claim 1, wherein a region of the hose segment that is not circumferentially closed in cross-section faces the discharge port.

4. The solid bowl screw centrifuge of claim 1, wherein the hose segment bears, spaced apart from regions of direct or indirect fastening in the solids capture chamber, in at least one region, on its outside facing away from the discharge port, against an inside of a wall of the solids capture chamber.

5. The solid bowl screw centrifuge of claim 1, wherein the hose segment has a spacing with respect to all insides of the solids capture chamber, except in regions of direct or indirect fastening in the solids capture chamber.

6. The solid bowl screw centrifuge of claim 1, wherein the hose segment is composed completely of the elastomeric material.

7. The solid bowl screw centrifuge of claim 1, wherein the hose segment is a hybrid part composed partially of the elastomeric material and partially of a rigid material.

8. The solid bowl screw centrifuge of claim 1, wherein a space not closed off so as to be pressure-tight is formed between the hose segment and the solids capture chamber.

* * * * *